United States Patent [19]

Hronek et al.

[11] 4,319,630

[45] Mar. 16, 1982

[54] TUBULAR HEAT EXCHANGER

[75] Inventors: George Hronek, Dayton; Richmond A. Gooden, Kettering, both of Ohio

[73] Assignee: United Aircraft Products, Inc., Dayton, Ohio

[21] Appl. No.: 967,473

[22] Filed: Dec. 7, 1978

[51] Int. Cl.[3] ..... F28F 11/00

[52] U.S. Cl. ..... 165/70; 165/35; 165/140; 165/164

[58] Field of Search ..... 165/35, 70, 71, 104 R, 165/140, 164

[56] References Cited

U.S. PATENT DOCUMENTS

| | | | |
|---|---|---|---|
| 686,313 | 11/1901 | Mann | 165/140 |
| 1,840,835 | 1/1932 | Davis | 165/35 |
| 2,256,882 | 9/1941 | Sebald | 165/140 |
| 2,653,014 | 9/1953 | Snaider | 165/140 |
| 2,819,882 | 1/1958 | Stephani | 165/140 |
| 2,920,874 | 1/1960 | Gardner | 165/140 |
| 3,907,026 | 9/1975 | Mangus | 165/70 |

*Primary Examiner*—Albert W. Davis

*Assistant Examiner*—Margaret A. Focarino

*Attorney, Agent, or Firm*—J. E. Beringer

[57] ABSTRACT

A tubular heat exchanger, the core of which is comprised of two sets of U-shaped tubes facing in opposite directions. A header plate receives the ends of one set of tubes. Another, longitudinally spaced, header plate receives the ends of the other set of tubes, and the sets of tubes between the header plates are in a substantially interfitting relation. A manifolding means at the one header plate provides for flow of a first fluid at one temperature into the one ends of the one set of tubes and out the other ends thereof. Other manifolding means at the other header plate provides for similar flow of a second fluid at a different temperature through the other set of tubes. Intermediate their ends, the tubes of the different sets are in a nested, companion relation promoting a transfer of heat between the different flowing fluids. The core can be surrounded by a shell apertured for venting or draining of a leaked fluid or for flow of a third fluid over and around the assembled tubes.

6 Claims, 8 Drawing Figures

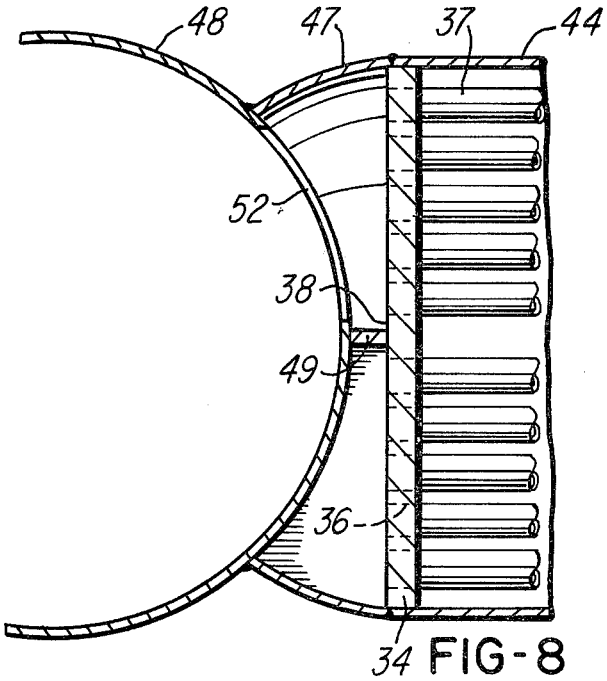
FIG-8
FIG-6
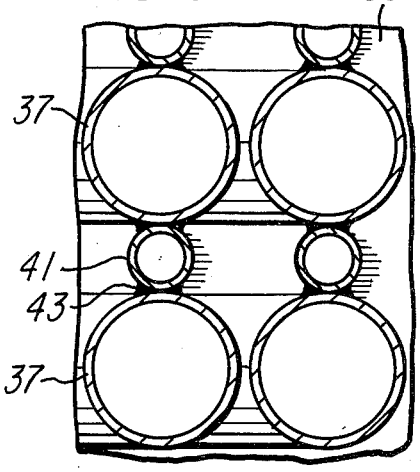
FIG-7
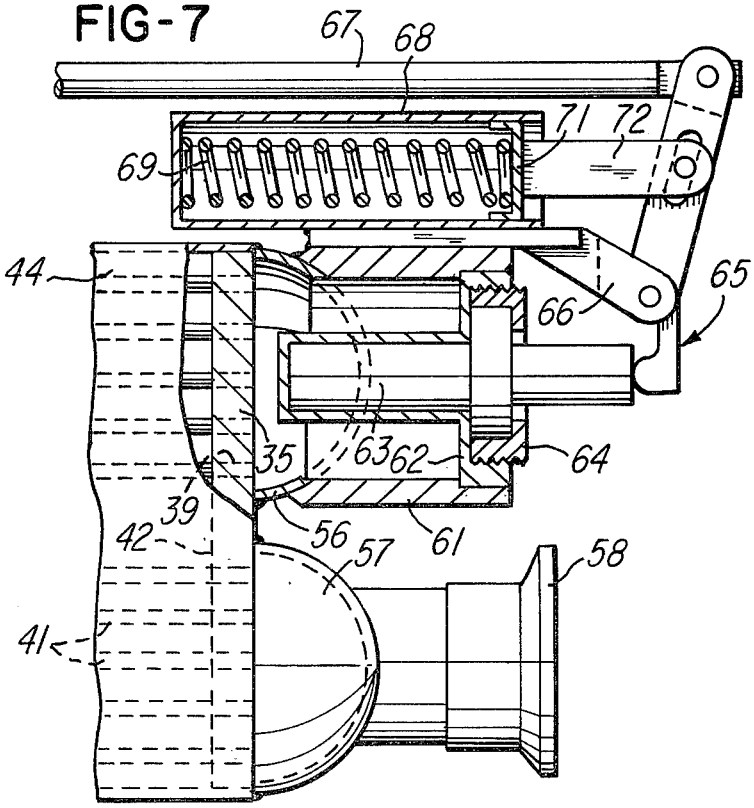

TUBULAR HEAT EXCHANGER

BACKGROUND OF THE INVENTION

Heat exchangers of the concern of this invention provide for flow of fluids of different temperature in a physically separated but heat transfer relation. For example, in a tubular heat exchanger, a first fluid is caused to flow through a tube or assembly of tubes while at the same time a second fluid is caused to flow over and around the tube or assembly of tubes. A transfer of heat between the fluids takes place through the tube wall or walls. A surrounding shell and header plates and manifolding means at the header plates are usually provided in order that the fluids may be confined and controlled in their flow and in order to enforce separation of the fluids.

It is frequently undesirable that the fluids be allowed direct physical contact with one another, and an optimal design criterion stipulates that no single leak, caused either by fracture of a tube wall or failure of a tube-to-header joint shall result in mixing of the fluids. Leak protected heat exchangers are known in the prior art (an example being that of U.S. Pat. No. 3,825,061, dated July 23, 1974), but devices meeting the single leak test above mentioned are unknown. In particular, are tubular heat exchangers unknown in which neither a tube wall fracture nor a failure of a tube-to-header joint will result in direct physical contact between separated fluids.

SUMMARY OF THE INVENTION

In accordance with the present invention, a tubular heat exchanger includes a pair of header plates. One series or set of U-shaped tubes has its ends installed in one of the header plates with intermediate portions projecting perpendicularly therefrom. The tubes are in rows adapted to interfit with like rows of similar tubes installed in the other header plate. A bringing of the header plates into an opposed, predetermined spaced relation positions the rows of the different series or sets of tubes in a side by side, companion relation. Corresponding tubes of companion rows may be brazed together, but conditions are in any event established conducive to a transfer of heat between fluids of different temperature in the different series of tubes. Manifolding means at each header plate controls a flow of a respective fluid into and out of communicating ends of the tubes associated with that plate. A vented or drained shell surrounds the core comprising the header plates and tubes. A fracture of a tube wall in a heat exchanger so constructed will allow fluid flowing in that tube to escape into the shell interior from which it will be vented or drained. The escaping fluid cannot mix with the other fluid with which it is in heat transfer relation, which other fluid remains confined in the tubes through which it flows. Similarly, a failure of a joint at the location where a tube end is received in a header plate cannot result in mixing of the fluids, since, in this case, a leaked fluid escapes either into the vented shell or into the manifolding means associated with flow of that fluid.

In another aspect of the invention, the described structure may serve as a three-fluid heat exchanger, the third fluid being a fluid caused to flow through the shell to be in contact therein with the exteriors of surrounded tubes.

An object of the invention is to provide a tubular heat exchanger substantially in accordance with foregoing remarks and in accordance with descriptions to follow.

Other objects and structural details of the invention will appear from the following description, when read in connection with the accompanying drawings, wherein:

FIG. 6 is a detail view of brazed tubes in accordance with the illustrated embodiment of FIG. 5, and relatively enlarged;

FIG. 7 is a fragmentary view in side elevation, taken substantially along the line 7—7 of FIG. 5; and FIG. 8 is a fragmentary view in cross section, taken substantially along the line 8—8 of FIG. 5.

Figure 1:
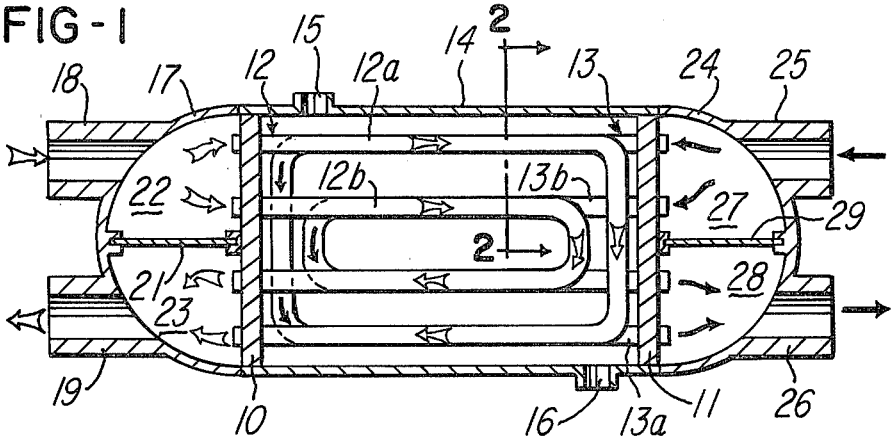
FIG. 1 is a diagrammatic view of a tubular heat exchanger in accordance with a first illustrated embodiment of the invention.
Figure 2:
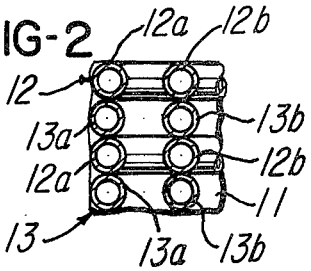
FIG. 2 is a detail view of rows of tubes in accordance with the embodiment of FIG. 1.

Referring to the drawings, a tubular heat exchanger according to the diagrammatic illustrations of FIGS. 1 and 2 includes a pair of longitudinally spaced apart header plates 10 and 11. These, together with separate sets or series of tubes 12 and 13 make up a heat exchanger core. The series or set of tubes 12 are bent intermediate their ends to have a U-shaped configuration and opposite ends of each tube 12 are received in provided accommodating apertures in the header plate 10. Tubes 12*a* and 12*b* are representative, as will be seen, of multiple tubes 12 arranged in multiple rows. It will be understood, in this connection, that the differing tubes in each row have differing configurations, as indicated by a comparison of the tubes 12*a* and 12*b*, to adapt to their individual positions within a row. The tubes 12 extend perpendicularly from the header plate 10 and at their closed or bent ends position in an adjacent, approaching relation to the header plate 11. Open ends of the tube 12 open through the header plate 10 and it will be observed that the opposite ends of each tube position respectively to opposite sides of what may be regarded as a transverse, median portion of the header plate 10.

The tubes 13 are represented by tubes 13*a* and 13*b* and are configured like the tubes 12 and are mounted in the header plate 11 in the same manner that tubes 12 are mounted in header plate 10. In the instance of header plate 11, and its tubes 13, however, the rows of tubes 13 are vertically offset from the tubes 12. Accordingly, if it be assumed that sub-assemblies comprising a header plate 10 and tubes 12 and a header plate 11 and tubes 13 have been completed, if the header plates 10 and 11 are aligned and moved in an approaching sense relative to one another then the rows of tubes 12 and 13 will interfit and corresponding tubes of adjacent rows will occupy an overlying-underlying, companion relation to one another. In the illustrated instance, companion tubes are in a substantially contacting relation to one another and in this position are metallurgically bonded together. The relationship of the tubes 12 and 13 in an assembled position of the core is diagrammatically illustrated in FIG. 2 wherein rows of tubes 12 and 13 are shown in a superposing, touching relation.

Further in accordance with the diagrammatic disclosure of FIG. 1, the header plates 10 and 11 are bridged by a shell 14 which surrounds and encloses the assembly of tubes 12–13. The shell 14 is appropriately vented or drained, as by apertures 15 and 16 therein. A manifold 17 is fixed, as by welding, to one end of the shell 14 and includes an inlet opening 18 and an outlet opening 19. The interior of the manifold 17 is divided by a partition member 21 into an inlet chamber 22 and an outlet chamber 23 communicating respectively with the inlet 18 and outlet 19. Partition 21 appropriately bridges the space between manifold 17 and the median portion of the header plate 10 in such manner that the tubes 12 at their one ends communicate with chamber 22 and at their opposite ends communicate with chamber 23. Accordingly, a fluid admitted to chamber 22 by way of inlet 18 has access to all of the tubes 12 at their one ends. Confined and guided by the tubes 12, therefore, the fluid entering chamber 22 is directed in a U-shaped path through the core of the heat exchanger and returned to the manifold 17 where it discharges into chamber 23 and leaves the heat exchanger by way of outlet 19.

A manifold 24 attaches to the opposite end of shell 14, and, like the manifold 17, has an inlet 25 and an outlet 26 communicating with an inlet chamber 27 and an outlet chamber 28 as defined by an interior partition 29. A fluid admitted through inlet 25 to chamber 27 has access to the tubes 13 at their one ends and is conducted thereby in a U-shaped path through the heat exchanger core and back to the chamber 28 for discharge at outlet 26. Within the heat exchanger, therefore, first and second fluids as directed to manifolds 17 and 24 flow in U-shaped paths which are in an adjacent relation to one another by reason of the adjacent, substantially contacting relation of the rows of tubes 12 and 13. If the separated fluids are brought to the heat exchanger at different temperatures, heat transfer occurs within the device which thus accomplishes a desired fluid heating or fluid cooling function.

Further, the structure avoids undesired mixing of the fluids in the event of any single failure of material or of joints. Thus, if a tube 12 or a tube 13 fractures, flowing fluid can escape therefrom but its escape is only into the interior of shell 14 from which it is appropriately vented or drained. The escaping fluid does not have access to the fluid with which it is in heat transfer relation since that fluid continues to be confined and guided within the other set or series of tubes. The ends of tubes 12 and 13 are received in apertures in the header plates 10 and 11 and are secured therein by mechanical means or by other means forming a seal and a bond between the tubes and headers. The tube-to-header joints so defined can fail and so provide a less than perfect seal around an installed tube end. In this instance, fluid in a manifold 17 or a manifold 24 may have access through the failed joint to the interior of shell 14. As in the instance of a ruptured tube, however, the escaping fluid is denied access to or mixing with the other fluid but rather is vented harmlessly out of the system by way of apertures 15 and 16.

The heat exchanger has been disclosed as a leak protected device operating with respect to two different fluids brought into heat transfer relation within separated, confined flow circuits, and the invention has important utility in this respect. It will be evident, however, that the device as disclosed is also useful as a three-fluid heat exchanger. In this use of the device, the shell apertures 15 and 16 would become inlet and outlet openings for a third fluid. The third fluid, confined by shell 14, will flow over and around the tubes 12 and 13 of the other fluid circuits and be in heat transfer relation to fluids of the other circuits through the tube walls. As an example of use thereof, two different fluids, both in need of cooling or of heating would be brought respectively to the manifolds 17 and 24 and caused to flow through the respective sets of tubes 12 and 13 as above described. A third fluid, capable of performing the desired heating or cooling function, would be directed through the shell 14 by way of the apertures 15 and 16, and, in contacting the tube exteriors, effect the desired temperature modification. In such an instance of use, the tubes 12 and 13 might advantageously be spaced apart to allow a free movement of the third fluid over and around the tubes of the tube core.

Figure 3:
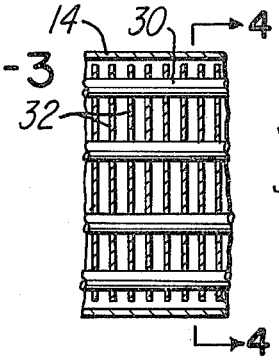
FIG. 3 is a view like FIG. 1, fragmentary in form, showing a second illustrated form of the invention.
Figure 4:
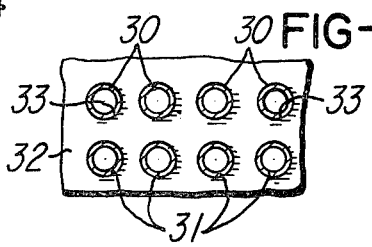
FIG. 4 is a view like FIG. 2, showing rows of tubes in accordance with the second illustrated embodiment of the invention.
Figure 5:
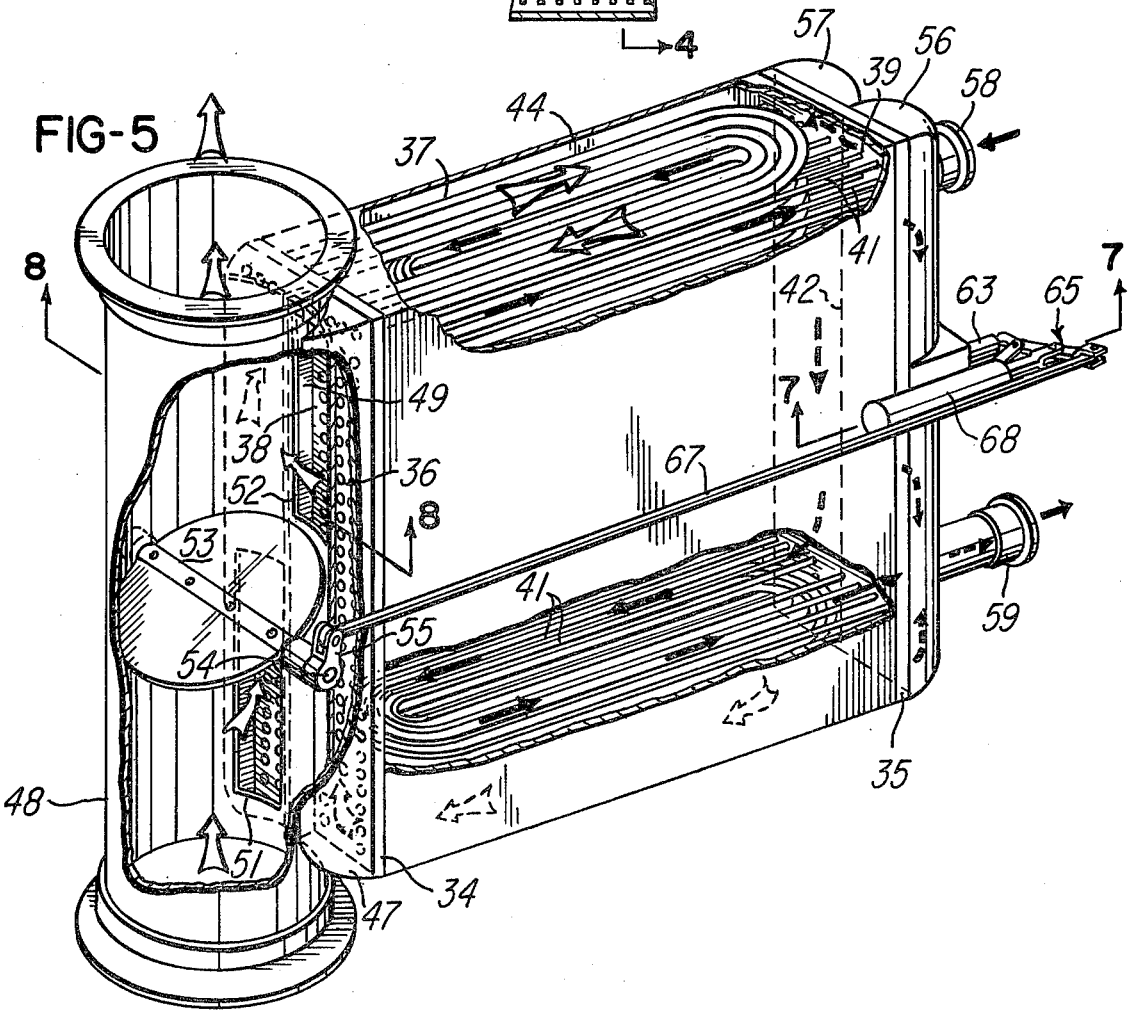
FIG. 5 is a view in perspective of a heat exchanger substantially as diagrammatically indicated in FIG. 1, shown adapted for air and liquid fluid flow.

In an alternate form of the invention, as shown in FIGS. 3 and 4, a tubular heat exchanger like that of FIG. 1 is contemplated except that tubes 30 and 31, corresponding to tubes 12 and 13, are spaced apart from one another and from corresponding tubes of adjacent sets or rows. Further in this embodiment, at least a portion of the space between header plates between which tubes 30 and 31 extend, is occupied by multiple relatively thin plates 32. The plates 32 are relatively closely spaced apart and they have apertures 33 therein accommodating passage of the tubes 30 and 31 therethrough. The tubes 30 and 31 are relatively closely received within the openings 33, and, ideally, the location of the passage of each tube 30 and 31 through each plate 32 is made a brazed joint. In any event, the plates 32 are in common contact with the rows of tubes 30 and 31 and provide a means of heat transfer. Fluids flowing through the sets or series of tubes 30 and 31 accordingly are in heat transfer relation through the tube walls and through interconnecting webs of material as defined by the plates 32. An apparatus as shown in FIGS. 3 and 4 accordingly is useful either as a two-fluid, leak protected heat exchanger or as a three-fluid heat exchanger, substantially in the same manner as the structure of FIGS. 1 to 2.

FIGS. 5, 6, 7 and 8 illustrate an actual tubular heat exchanger constructed for two-fluid leak protected use, substantially in accordance with the concept expressed in FIGS. 1 and 2. In this illustrated instance, a pair of rectangular plates 34 and 35 correspond to and represent header plates 10 and 11. The header plate 34 has rows of perforations 36 receiving opposite ends of a series or set of tubes 37. Opposite ends of the tubes 37 open through the plate 34 to opposite sides of an imperforate median area 38. The tubes 37 have a U configuration and project perpendicularly from the plate 34, substantially in the manner described in connection with tubes 12 and header plate 10 of FIG. 1. Header plate 35 similarly is provided with rows of apertures 39 receiving the ends of a series or set of tubes 41 corresponding to the tubes 13 of the FIG. 1 illustration. U-shaped tubes 41 extend perpendicularly from plate 35 and at their opposite ends position to either side of an imperforate median area 42. Corresponding rows of apertures 36 and 39 are offset from one another. Accordingly, when the header plates 34 and 35 are aligned and moved in an approaching relation the sets of tubes 37 and 41 move to an interfitting relation, with such approaching motion being continued until bent portions of the tubes 37 achieve an adjacent relation to header plate 35 and bent portions of tubes 41 achieve a corresponding adjacent relation to header plate 34. Rows of tubes 37 and 41 accordingly are in an alternating relation to one another, and, in accordance with the illustrated embodiment, are in a substantially contacting relation. For a more secure joinder of the assembled core, and for better heat transfer between substantially contacting tubes, the parts may be united in a brazing or like operation. This may be carried out, for example, by placing braze material on one or both faces of both header plates 34 and 35 and by placing braze material on the exterior tube surfaces where they are adapted to contact one another as the result of assembly. Raising the temperature to a value sufficient to cause the braze material to flow, and subsequent cooling, results in the braze material forming a seal and a bond around the tube ends within the header plates and along mutually contacting areas of the tubes intermediate their ends. Upon completion of the brazing operation, the contacting tubes 37 and 41 assume a relationship substantially as shown in FIG. 6 wherein braze fillets 43 not only interconnect adjacent tubes 37 and 41 but provide also for a positive transmission of heat therebetween.

The differential in diameter between the header plate apertures 36 and 39, and between the tubes 37 and 41 respectively accommodated therein, is due to the fact that in the illustrated instance one of the fluids flowing through the heat exchanger is air and the other a liquid. Apparatus in accordance with the invention might, for example, be useful in employing relatively cool flowing liquid fuel to reduce the temperature of excessively heated air required to be cooled for an intended use thereof. The heat exchanger core as represented by tubes 37 and 41 and header plates 34 and 35 is surrounded by a shell 44 configured for close fitting contact with all sides of the plates 34 and 35. Suitable vent or drain openings (not shown) are formed in the shell, these corresponding in function to shell apertures 15 and 16 of FIG. 1. A manifold 47 is fixed to one end of the shell 44, or that end surrounding header plate 34. Within a cutout center portion of the manifold 47 is introduced a tubular duct 48. A partition member 49 extends lengthwise of the header plate 34 and bridges the space between median portion 38 of the header plate and a wall of duct 48. The partition member 49 defines inlet and outlet manifold chambers to either side thereof communicating with opposite ends of the tubes 37 and corresponding respectively to inlet and outlet chambers 22 and 23 of the FIG. 1 disclosure. In the duct 48, toward what may be regarded as a lower end thereof is an elongated slot 51. A like slot 52 is located in what may be regarded as an upper part of the duct 48 and in a circumferentially offset relation to slot 51. The slots 51 and 52 place the interior of duct 48 respectively into communication with the different manifold chambers on opposite sides of partition member 49. Within duct 48, between slot locations 51 and 52 is a butterfly valve 53 mounted on a shaft 54 which extends laterally outside the duct and has an operating arm 55 pinned thereto. The duct 48 is open at its opposite ends and what may be regarded as its lower end serves as an air inlet. Air entering the duct may flow freely from end to end thereof, in bypassing relation to the heat exchanger, if the butterfly valve 53 is open. In the event of a closed or partly closed position of the valve, however, some or all of the air entering duct 48 is blocked from a free passage through the duct and is compelled to pass through slot 51 and occupy the manifold chamber to one side of partition member 49. There it is allowed to enter the one ends of tubes 37, flow in a U-shaped path through the heat exchanger core and discharge to the manifold chamber on the other side of partition 49. At this time, the air again has access to the duct 48, through slot 52 and discharges through an upper or outlet end of the duct.

At the opposite end of shell 44 is a pair of manifolds 56 and 57. These are in a side by side relation and attach directly to the header plate 35, the line of separation between the manifolds coinciding with median portion 42. The interiors of manifolds 56 and 57 are accordingly in a communicating relation with opposite ends of the rows of tubes 41. Manifold 57 has what may be regarded as a liquid inlet 58 while manifold 56 has what may be regarded as a liquid outlet 59, the two being in a longitudinally spaced relation to one another and being, due to the separated relationship of the manifolds, on opposite sides of median portion 42 of the header plate. Liquid entering inlet 58 is distributed throughout manifold 57 and has access to all of the tubes 41 at their one ends. Flowing into the communicating tube ends, the liquid is directed by the tubes in a U-shaped path and emerges therefrom into manifold 56 to be discharged by way of outlet opening 59. The air in tubes 37 and the liquid in tubes 41 accordingly are in a heat transfer relation by reason of the relationship of the series of tubes to one another and there is as a consequence a modification of the temperature of one of the flowing fluids by reference to the other. The construction is leak protected in the same manner as is described in connection with FIG. 1 since a leak either at the tube-to-header joints or as a result of a rupture of a tube intermediate its ends can only result in an escaping fluid entering the interior of shell 44 where it is appropriately drained or vented.

Mechanism is disclosed for operating the butterfly valve 53 in accordance with a changing liquid temperature. Such an arrangement may be useful, for example, in avoiding an overheating of the liquid by limiting the extent to which the heated air may flow in heat transfer relation to the flowing liquid. The manifold 56 has an opening therein surrounded by a relatively projecting housing 61. The outer end of the housing 61 is closed by a tubular sleeve 62 having a well portion projecting axially within the bushing toward the manifold interior. Within the sleeve 62 is a thermal element 63 which may be any one of various known devices capable of relatively powerful expansion in an axial sense when heated. The thermal element 63 is confined by a cap 64 in sleeve 62 and projects therethrough into contact with one end of a lever means 65. The latter is pivotally connected to a bracket 66 fixed to housing 61. At an outer end thereof, lever means 65 is pivotally connected to one end of a rod 67 which extends across the heat exchanger shell and attaches to arm 55 of the butterfly valve operating shaft 54. Extension of the thermal element 63 rocks lever 65 in a counterclockwise direction as viewed in FIG. 7 and effects an axial thrust on rod 67 in a direction to turn arm 55 in a direction to open valve 53. According to the operation of the disclosed mechanism, if the flowing liquid absorbs sufficient heat from the heated air to raise its temperature above a predetermined value, thermal element 63 extends, and, through an actuation of rod 67, opens butterfly valve 53. All or some part of the air entering duct 48 will accordingly flow around valve 53 in bypassing relation to slot opening 51 and there will be a consequent reduction in the amount of heat rejected to the flowing liquid. Still referring to FIG. 7, a spring housing 68 is mounted on bracket 66 and confines a compression spring 69 therein. The latter acts through a piston 71 to extend an extension 72 thereof, the latter being pivotally connected to the lever means 65 intermediate its points of attachment to bracket 66 and rod 67. Spring 69 is compressed by a counterclockwise movement of the lever means 65, responsive to an extension of thermal element 63, and the force stored therein is utilized in a return of the lever means in a clockwise direction as the liquid in manifold 56 cools from its predetermined high temperature. Such a motion of the lever means 65 retracts rod 67 and moves valve 53 again toward a closed position in duct 48.

A heat exchanger construction to meet specific heat transfer requirements provides a number, size and relationship of tubes appropriate to the known flow rate, temperature and other factors of the fluid circuits. Air surrounding the tubes is useful to increase heat transfer efficiency between the tubes over that achieved by direct contact therebetween. If it is desired further to enhance heat transfer, the tube core or bundle may be packed with a commercially available product known as "thermal grease". This is a thick, viscous substance containing particulate matter of good thermal conductivity. In filling the spaces between and around the tubes, the "grease" acts as a heat conductor for a more facile and thorough transfer of heat between the tubes.

What is claimed is:

1. A tubular heat exchanger, including a pair of perforate header plates, bent fluid conducting tubes associated with each plate having their open ends installed in said plate to respectively opposite sides of a median portion thereof, said tubes projecting perpendicularly from said plate and being arranged in rows, and said header plates with installed tubes being in an opposed relatively approaching relation wherein projecting rows of tubes from each plate are in offset relation to and interfit with corresponding rows of tubes from the other plate, and means for effecting a directed flow to and from said header plates to opposite sides of said median portion of respectively different fluids, said means for effecting a directed flow including manifold means at one of said header plates providing separated chambers communicating with respective open ends of tubes associated with said one header plate, an open ended fluid flow duct in an adjacent connected relation to said manifold means into one end of which a first one of said different fluids flows for exit from an opposite end, said manifold means having offset apertures intercommunicating said duct and said separated chambers at locations to opposite sides of an intermediate location in said duct, and an adjustable valve means in said duct at said intermediate location.

2. A tubular heat exchanger according to claim 1, said means for effecting a directed flow further including other manifold means at the other one of said header plates providing separated chambers communicating with respective open ends of tubes associated with said other one of said header plates, said other manifold means having an inlet and an outlet for a second one of said different fluids communicating with respective separated chambers therein, thermally sensitive power means installed in said other manifold means to sense the temperature of the said second one of said different fluids in the separated chamber communicating with said outlet, and a valve actuating mechanism extending from said power means externally of said heat exchanger from end to end thereof to adjust said valve in accordance with sensed changes in the temperature of the fluid flowing to said outlet.

3. A tubular heat exchanger according to claim 1, said interfitting rows of tubes superposing one over the other in an alternating relation, said fluid flow duct orienting in a sense transversely of the superposing rows of tubes.

4. A tubular heat exchanger according to claim 1, said apertures being laterally offset to either side of said median portion of the one said header plate and being longitudinally offset respectively above and below said intermediate location of said duct.

5. A tubular heat exchanger, including first and second tube means each bent substantially to a U configuration and orienting oppositely of one another so that ends of one tube means face in one direction and ends of the other tube means face in the opposite direction, first and second tube means being in a companion relation between their ends, companion tube means intermediate their ends being metallurgically bonded in a contacting relation to one another, longitudinally spaced apart header plates in respective ones of which ends of said tube means are received, means for manifolding a first fluid into and out of tube ends at a first header plate, and means for manifolding a second fluid into and out of tube ends at a second header plate.

6. A tubular heat exchanger, including a pair of perforate header plates, bent fluid conducting tubes associated with each plate having their open ends installed in said plate to respectively opposite sides of a median portion thereof, said tubes projecting perpendicularly from said plate and being arranged in rows, and said header plates with installed tubes being in an opposed relatively approaching relation wherein projecting rows of tubes from each plate interfit with rows of tubes from the other plate, corresponding tubes of adjacent rows of tubes being metallurgically bonded to one another, and means for effecting a directed flow to and from said header plates to opposite sides of said median portion of respectively different fluids.

* * * * *